US008960841B2

(12) United States Patent
Utsunomiya et al.

(10) Patent No.: US 8,960,841 B2
(45) Date of Patent: Feb. 24, 2015

(54) PRINTING APPARATUS AND PRINTING METHOD

(71) Applicant: Seiko Epson Corporation, Tokyo (JP)

(72) Inventors: Kohei Utsunomiya, Matsumoto (JP); Naoki Kayahara, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/939,376

(22) Filed: Jul. 11, 2013

(65) Prior Publication Data

US 2014/0015883 A1 Jan. 16, 2014

(30) Foreign Application Priority Data

Jul. 11, 2012 (JP) ..... 2012-155253

(51) Int. Cl.

| | |
|---|---|
| ***B41J 29/38*** | (2006.01) |
| ***B41J 11/00*** | (2006.01) |
| ***B41J 2/21*** | (2006.01) |
| ***B41J 13/00*** | (2006.01) |

(52) U.S. Cl.

CPC ..... *B41J 11/008* (2013.01); *B41J 2/2117* (2013.01); *B41J 13/0045* (2013.01)

USPC ..... 347/16

(58) Field of Classification Search

CPC ..... B41J 2/2117

USPC ..... 347/16

See application file for complete search history.

(56) References Cited

U.S. PATENT DOCUMENTS

| | | | | |
|---|---|---|---|---|
| 6,341,835 | B1 * | 1/2002 | Ogawa et al. | 347/16 |
| 6,480,217 | B1 | 11/2002 | Inoue et al. | |
| 7,244,021 | B2 * | 7/2007 | Arai | 347/102 |
| 7,562,957 | B2 | 7/2009 | Mills et al. | |
| 7,828,411 | B2 * | 11/2010 | Inoue et al. | 347/34 |
| 8,430,499 | B2 * | 4/2013 | Usuda et al. | 347/101 |
| 8,632,154 | B2 * | 1/2014 | Aoki et al. | 347/15 |
| 2002/0154182 | A1 | 10/2002 | Takahashi et al. | |
| 2005/0099440 | A1 * | 5/2005 | Kawase et al. | 347/12 |
| 2005/0237352 | A1 | 10/2005 | Yoneyama | |
| 2007/0279470 | A1 * | 12/2007 | Arai | 347/102 |
| 2009/0244159 | A1 * | 10/2009 | Kusunoki | 347/16 |
| 2010/0238211 | A1 * | 9/2010 | Usuda et al. | 347/9 |
| 2013/0215171 | A1 * | 8/2013 | Usuda et al. | 347/9 |
| 2013/0278665 | A1 * | 10/2013 | Imamura | 347/16 |

(Continued)

FOREIGN PATENT DOCUMENTS

| | | |
|---|---|---|
| JP | 05-064870 | 3/1993 |
| JP | 2001-001560 | 1/2001 |

(Continued)

*Primary Examiner* — Julian Huffman

(74) *Attorney, Agent, or Firm* — Workman Nydegger

(57) ABSTRACT

A printing apparatus includes a printing mechanism performing printing by ejecting ink from a printing head which is relatively moved with respect to the printed medium and a printing control section controlling operation of the printing mechanism. A plurality of nozzle rows are formed side by side for each of ink types in a main scanning direction in the printing head. The printing mechanism includes a transportation section which is configured so as to be capable of switching a transportation direction of the printed medium between a first direction and a second direction. The printing control section performs the printing by switching the first printing mode which uses two or more nozzle rows and the second printing mode which uses one or more nozzle rows, which is caused by switching the transportation direction.

4 Claims, 6 Drawing Sheets

(56) References Cited

U.S. PATENT DOCUMENTS

| | | | | |
|---|---|---|---|---|
| 2013/0328955 | A1* | 12/2013 | Utsunomiya | 347/12 |
| 2014/0078200 | A1* | 3/2014 | Usuda | 347/12 |
| 2014/0098169 | A1* | 4/2014 | Aoki et al. | 347/102 |

FOREIGN PATENT DOCUMENTS

| | | |
|---|---|---|
| JP | 2002-307672 | 10/2002 |
| JP | 2006-247991 | 9/2006 |
| WO | WO 2005/105452 | 11/2005 |

* cited by examiner

FIRST NOZZLE USE SETTING

SECOND NOZZLE USE SETTING

THIRD NOZZLE USE SETTING

PRINTING APPARATUS AND PRINTING METHOD

BACKGROUND

1. Technical Field

The present invention relates to a technique that prints an image configured of an ink layer having a plurality of layers.

2. Related Art

As one of ink jet printers, a serial type ink jet printer is known which forms the image by ejecting ink from a printing head while moving the printing head in a main scanning direction and a sub-scanning direction. In addition, a technique is known which prints the image configured of an ink layer having a plurality of layers by using the ink jet printer.

For example, in JP-A-2006-247991, a technique is disclosed in which a base layer is formed using a white ink on a transparent printed medium and printing is performed using a process color ink on the formed base layer. In addition, JP-A-2006-247991 discloses a technique (hereinafter, also referred to as a nozzle dividing technique) which ejects one of the white ink and the process color ink using a nozzle group of the upstream side of the nozzle row which is formed in the printing head for each type of the ink and ejects the other ink using a nozzle group of the downstream side. According to the nozzle dividing technique, the ink layer having two layers can be formed while transporting the printed medium once over a length of the printed medium.

JP-A-2001-1560, International Publication No. 2005/105452 and JP-A-5-64870 are examples of the related art.

When the printed matter configured of the ink layer having five or more layers is printed using these techniques, various problems may occur. The printed matter configured of the ink layer having five or more layers can be a printed matter which forms, on a transparent printed medium, for example, a first color layer formed by a color ink, a first special gloss layer formed by a special gloss ink, a base layer formed by a white ink, a second special gloss layer formed by the special gloss ink and a second color layer formed by the color ink. The special gloss ink is ink expressing special gloss such as metallic effect. The printed matter can be a printed matter on which the image is visible from both surfaces of the printed medium.

However, when five layers are formed on one surface of the printed medium, the number of nozzles for each nozzle group which is divided is decreased if the configuration having five layers is made by dividing the nozzle rows in five and forming the divided each nozzle groups by one layer using the nozzle dividing technique described above. As a result, a printable range with one nozzle group is decreased and printing speed is extremely slow.

On the other hand, when the nozzle dividing technique is not used, since only one ink layer is formed during a process in which the printed medium is transported once over the length of the printed medium, it is necessary to repeat the process five to form the ink layer having five layers. As methods for repeating the transportation process of the printed medium, a method for automatically reversing the transportation direction of the printed medium and a method for repeatedly setting the printed medium by manual operation in an initial position may be considered. In any method, it is inevitable that the position of the printed medium is slightly shifted during a plurality of transportation processes. In other words, a relative position of each layer in a printed surface is shifted from a predetermined original position thereof. For example, when the position relationship between the first color layer and the first special gloss layer is shifted, special gloss effect which is expressed is varied. As a result, there is a concern that printing quality may be degraded.

In addition, when three layers are formed on one surface of the printed medium and two layers are formed on the other surface, a problem may occur in some cases, caused by printing on both surfaces of the printed medium. For example, when the printed matter of which both surfaces are printed is attached to a window of a shop so that a printed content is visible from any one of inside and outside of the shop, one of printed surfaces directly comes into contact with the window. In this case, there is a concern that the ink may be attached to the window. In other words, when peeling the attached printed matter, it is necessary to remove the attached ink.

As described above, a new printing technique is required which can preferably print a printed matter configured of an ink layer having five or more layers.

SUMMARY

The invention can be realized in the following embodiments or application examples.

APPLICATION EXAMPLE 1

According to this application example, there is provided a printing apparatus, which prints an image on a printed medium, including: a printing mechanism performing printing by ejecting ink from a printing head which is relatively moved with respect to the printed medium in a main scanning direction and a sub-scanning direction crossing the main scanning direction; and a printing control section controlling operation of the printing mechanism. A plurality of nozzle rows in which a plurality of nozzles ejecting the ink are arranged side by side in a predetermined range in the sub-scanning direction are formed side by side for each of ink types in the main scanning direction in the printing head. The printing mechanism includes a transportation section which is configured so as to be capable of transporting the printed medium in a first direction of the sub-scanning direction and a second direction opposite to the first direction, and is configured so as to be capable of switching a transportation direction of the printed medium which is transported in one of the first direction and the second direction to the other direction. The printing control section is configured so as to be capable of performing the printing by a first printing mode which performs the printing over an entire printing area on which the image is to be printed by using two or more nozzle rows having different ink types of the plurality of the nozzle rows; and a second printing mode which performs the printing over the entire printing area by using one or more nozzle rows including nozzle rows different from the two or more nozzle rows of the plurality of the nozzle rows. The printing control section performs the printing by switching the first printing mode and the second printing mode, which is caused by switching the transportation direction in the transportation section.

In this case, the ink layer having two layers can be formed by ejecting the ink on the same printing area with different timings between two or more nozzle rows in which the types of the ink are different from each other by the first printing mode while transporting the printed medium in the first direction. Then, the ink layer having one layer can be formed by the second printing mode while transporting the printed medium in the second direction by switching the transportation direction of the printed medium from the first direction to the second direction. After that, the ink layer having two layers can be formed by the first printing mode while transporting the printed medium in the first direction by switching the transportation direction of the printed medium from the second direction to the first direction. In other words, the printed matter can be printed which includes, on one surface of the printed medium, the ink layer having five layers which are formed in order of the ink layer having two layers formed by the first printing mode, the ink layer having one layer formed by the second printing mode, and the ink layer having two layers formed by the third printing mode, viewed from the printed medium. Accordingly, when performing the printing on the transparent printed medium, the printed matter on which the printed image is visible from both surfaces of the printed medium opposite to each other can be obtained. In addition, in the first printing mode, the ink layer having two layers can be formed during the transportation process in which the printed medium is transported once over the length (the length in the sub-scanning direction) of the printed medium. Thus, the shift of the relative position relationship between two layers is unlikely to occur compared to the case where the ink layer having one layer is formed by one transportation process. Accordingly, degradation of the printing quality can be suppressed. In addition, the ink layer for five layers can be printed by three transportation processes. Accordingly, the printing speed can be sped up compared to a case where the ink layer for five layers is printed in one time of the transportation process using the nozzle rows divided into five nozzle groups. Furthermore, since the printing can be performed on only one surface of two surfaces of the printed medium opposite to each other, the ink is not attached to a transparent member if the other surface is attached by coming into contact with the transparent member such as the window. In addition, the first nozzle row and the second nozzle row may be one or a plurality, respectively.

APPLICATION EXAMPLE 2

In the printing apparatus according to Application Example 1, the first printing mode may be an operation which performs the printing with respect to any printing area of the printed medium with the number of a first main scanning, and the second printing mode may be an operation which performs the printing with respect to any printing area of the printed medium with the number of times of a second main scanning which is less than the number of times of the first main scanning.

In this case, the ink layer having two layers can be preferably formed during one time of the transportation process with the number of times of the first main scanning which is greater than the number of times of the second main scanning in the first printing mode. In addition, the ink layer having one layer can be formed at high speed with the number of the second main scanning which is less than the number of the first main scanning in the second printing mode.

APPLICATION EXAMPLE 3

In the printing apparatus according to Application Example 1 or 2, the first printing mode may be an operation which performs the printing by a first nozzle use setting of which a use range is a first nozzle group of one of a downstream side and an upstream side which is the opposite side of the downstream side in which the printed medium is moved with respect to the printing head of the predetermined range in the first nozzle row of the two or more nozzle rows, and of which the use range is a second nozzle group of the other side in the second nozzle row which is different from the first nozzle row, and the second printing mode may be an operation which performs the printing by a second nozzle use setting of which the use range is an entire third nozzle row different from the first nozzle row and the second nozzle row.

In this case, in the first printing mode, the ink layer having two layers can be preferably formed using the first nozzle use setting during one transportation process. In addition, in the second printing mode, the ink layer having one layer can be formed at high speed using the entire third nozzle row.

APPLICATION EXAMPLE 4

In the printing apparatus according to any one of Application Examples 1 to 3, the control section may print the image configured of an ink layer having five layers on one surface of the printed medium by forming the ink layer having two layers by the first printing mode, by forming the ink layer having one layer by the second printing mode which is performed after the first printing mode, and by forming the ink layer having two layers by the first printing mode which is performed again after the second printing mode.

In this case, the printed matter configured of the ink layer having five layers can be preferably printed.

The invention can be realized in various embodiments. For example, the invention can be realized in embodiments such as a printing method described below as Application Example 5, a program used in the printing apparatus and a storage medium storing the computer readable program.

APPLICATION EXAMPLE 5

According to this application example, there is provided a printing method in which a printing apparatus performs printing by ejecting ink from a printing head which is relatively moved with respect to a printed medium in a main scanning direction and a sub-scanning direction crossing the main scanning direction, and which has a plurality of nozzle rows in which a plurality of nozzles ejecting the ink are arranged side by side in a predetermined range in the sub-scanning direction being formed side by side for each of the ink types in the main scanning direction, including: performing the printing over an entire printing area on which an image is to be printed by using two or more nozzle rows having different ink types of the plurality of the nozzle rows, in a state where the printed medium is transported in a first direction of the sub-scanning direction; performing the printing over the entire printing area by using one or more nozzle rows of the plurality of the nozzle rows, including the nozzle rows which are different from the two or more nozzle rows, in a state where the printed medium is transported in a second direction, which is caused by switching the transportation direction of the printed medium from the first direction to the second direction opposite to the first direction; and performing the printing over the entire printing area by using the two or more nozzle rows, in a state where the printed medium is transported in the first direction, which is caused by switching the transportation direction of the printed medium from the second direction to the first direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment

A-1. Configuration of Printer

Figure 1:
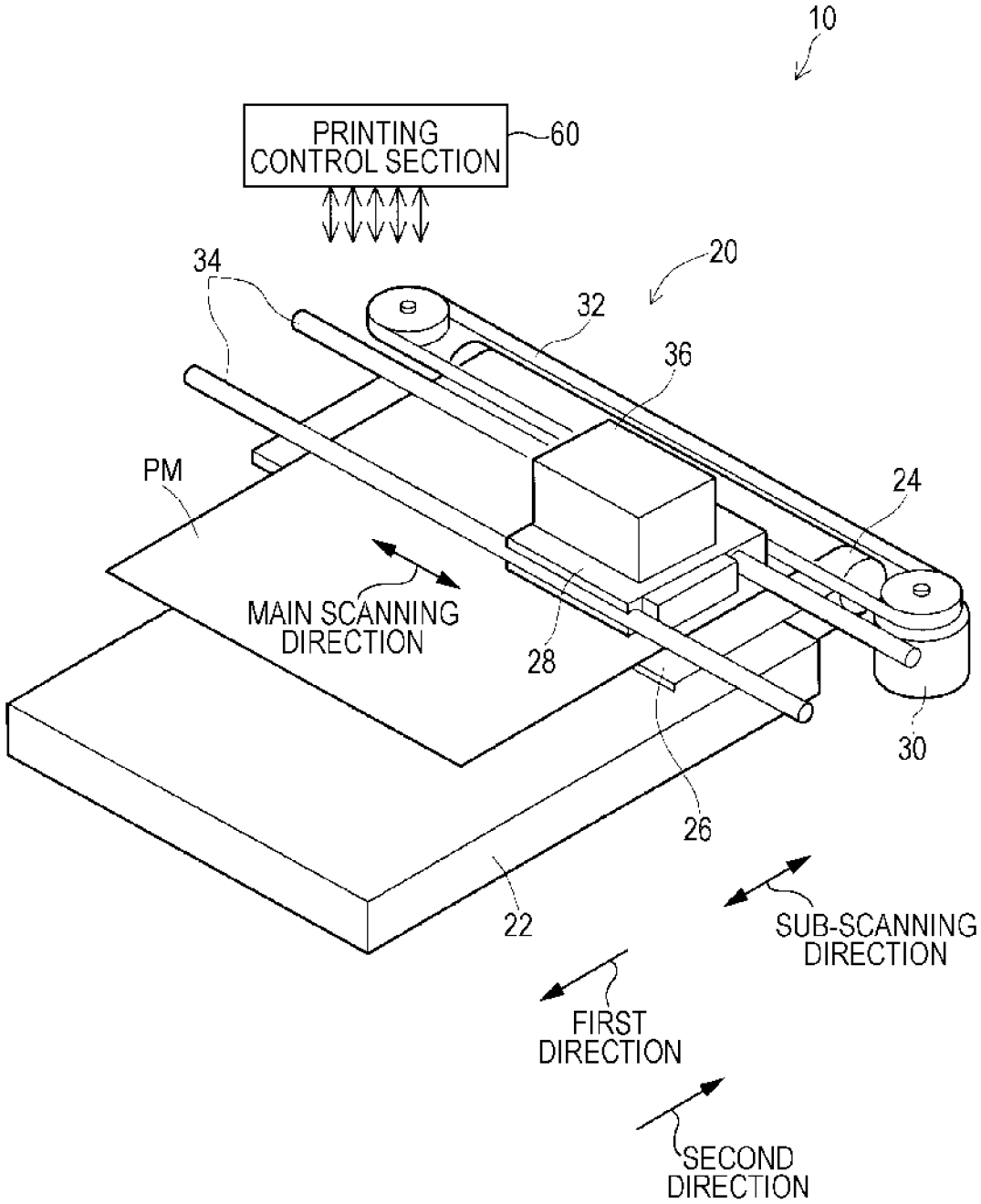
FIG. 1 is a schematic perspective view illustrating a main configuration of a printer as an embodiment of the invention.

FIG. 1 is a schematic perspective view illustrating a main configuration of a printer 10 as an embodiment of a printing apparatus of the invention. The printer 10 is an ink jet type printing apparatus which forms ink dots on a printed medium by ejecting ink from a plurality of nozzles thereby recording characters, figures, images or the like on the printed medium. The printer 10 is a so-called serial type printer.

The printer 10 includes a printing mechanism 20 and a printing control section 60. The printing mechanism 20 performs printing by ejecting the ink from a printing head 36 (details will be described below) which relatively moves with respect to the printed medium in a main scanning direction and a sub-scanning direction crossing the main scanning direction. The sub-scanning direction is a direction in which the printed medium is transported. The printing control section 60 includes a CPU for performing various types of arithmetic processing, a RAM for temporally storing and developing program or data, an EEPROM for storing program or the like which is executed by the CPU. The printing control section 60 performs exchange of signals with each part of the printing mechanism 20 and controls overall operation of the printing mechanism 20.

The printing mechanism 20 includes a paper stacker 22, a paper feeding roller 24 driven by a printed medium transportation mechanism 40 (not illustrated in FIG. 1), a platen 26, a carriage 28, a carriage motor 30, a traction belt 32 driven by the carriage motor 30 and a guide rail 34 for the carriage 28. The paper feeding roller 24 configures a part of the printed medium transportation mechanism 40 described below. The printing head 36 having a plurality of nozzles is mounted on the carriage 28.

A printed medium PM is taken up from the paper stacker 22 by the paper feeding roller 24 and is sent on a surface of the platen 26 in the sub-scanning direction. The carriage 28 moves along the guide rail 34 in the main scanning direction by being drawn with the traction belt 32 which is driven by the carriage motor 30. In the embodiment, the main scanning direction is perpendicular to the sub-scanning direction.

Figure 2:
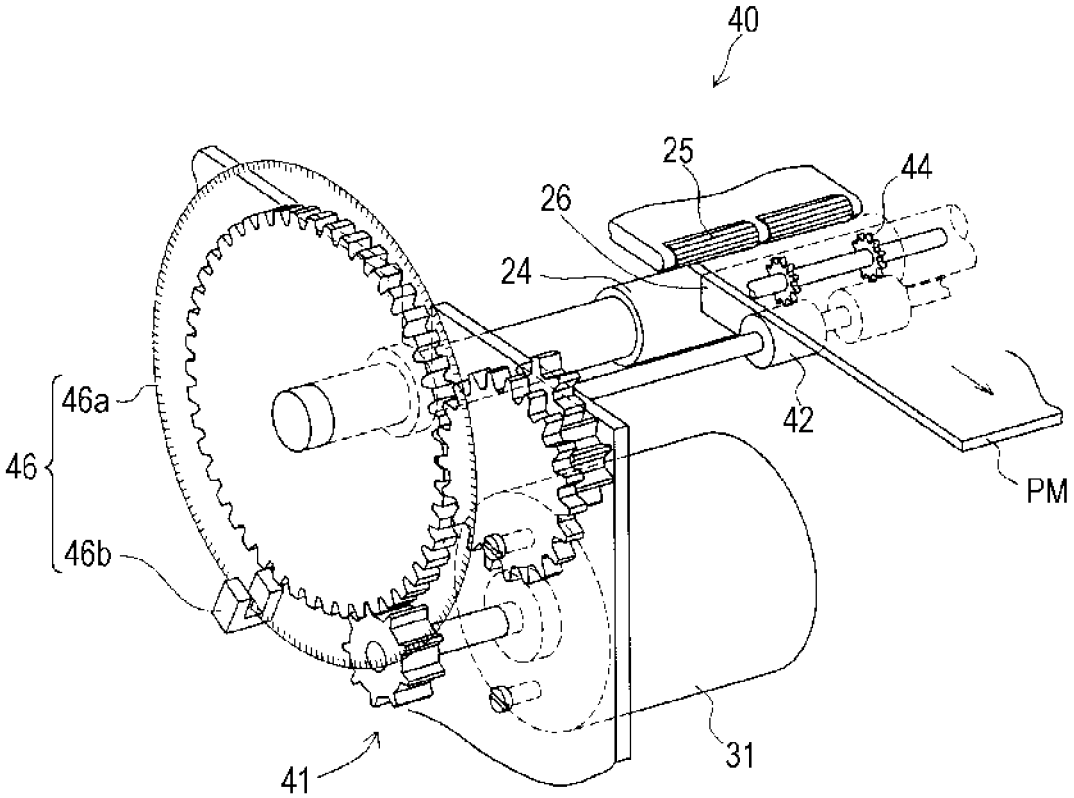
FIG. 2 is a perspective view illustrating a configuration of a printed medium transportation mechanism.

FIG. 2 is a perspective view illustrating a configuration of the printed medium transportation mechanism 40. The printed medium transportation mechanism 40 includes the paper feeding roller 24, a paper feeding motor 31, a gear train 41, a paper discharging roller 42 and the like. Power of the paper feeding motor 31 is transmitted to the paper feeding roller 24 and the paper discharging roller 42 via the gear train 41. The paper transportation roller 24 has a driven roller 25 and the paper discharging roller 42 has a knurling roller 44 as a driven roller thereof. The printed medium PM is sent in a state of being sandwiched by the rollers and moves on the platen 26.

In the embodiment, the printed medium transportation mechanism 40 can transport the printed medium PM in a first direction and a second direction by performing a forward and reverse control of the paper feeding motor 31 (see FIG. 1). The second direction is the opposite direction of the first direction. The first direction is a transportation direction of the printed medium PM when the printing is completed by transporting the printed medium PM once, throughout a length (a length in the sub-scanning direction) of the printed medium PM, in other words, throughout the whole printing area in which the image is to be printed. In this way, because the transportation direction of the printed medium PM is automatically reversed, it is also referred to as a back feed.

A shaft of the paper feeding roller 24 has a rotary encoder 46 configured of a sign plate 46*a* and a photo sensor 46*b*. A paper feeding amount (a feeding amount in the sub-scanning) is determined according to a pulse signal from the rotary encoder 46.

Figure 3:
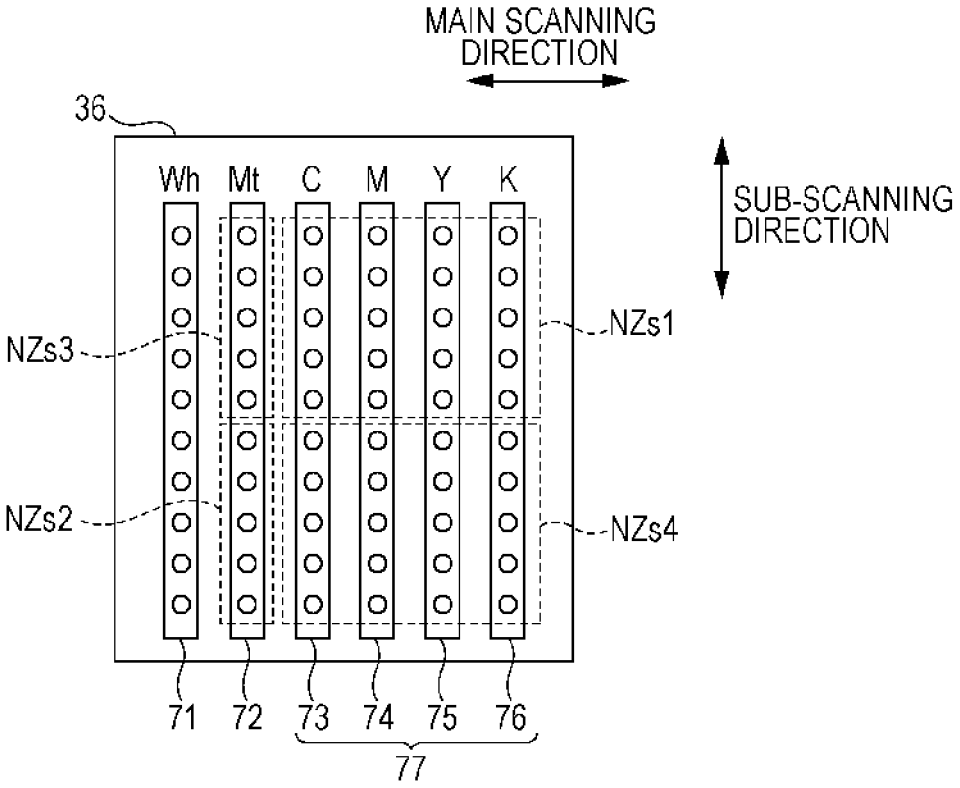
FIG. 3 is an explanatory view illustrating a nozzle arrangement of a printing head.

FIG. 3 illustrates an arrangement of the nozzles formed in the printing head 36. The nozzles illustrated in the drawing are formed on a lower surface of the printing head 36, in other words, on a surface facing the printed medium PM. The image is formed on the printed medium PM using the ink ejected from the nozzles. In the embodiment, the printing head 36 ejects six types of inks, specifically ejects cyan ink C, magenta ink M, yellow ink Y, black ink K, metallic ink Mt and white ink Wh. These inks are supplied from an ink cartridge (not illustrated in FIG. 1) mounted on the printer 10.

The cyan ink C, the magenta ink M, the yellow ink Y and the black ink K are inks to be used to reproduce the hue, brightness and chroma. These inks also collectively are referred to as a color ink Col. In this application, the color ink Col is a concept including the black ink and is not limited to cyan, magenta and yellow, and means one or more inks of hue of red, orange, green, blue and the like. The color ink may be regarded as ink to form an image layer. The metallic ink Mt is one type of special gloss ink expressing specific texture of a material. The metallic ink Mt expresses a metallic effect by containing a metallic pigment. The white ink Wh is ink for forming a base layer. The ink forming the base layer is not limited to the white ink Wh and may be a white-based ink having hue of slightly tinged white, and may be ink reproducing any hue.

As illustrated in FIG. 3, the printing head 36 has a plurality of nozzle rows 71 to 76 in which a plurality of nozzles are arranged side by side in a predetermined range in the sub-scanning direction. These nozzle rows are formed side by side for each of the ink types in the main scanning direction. The nozzle row 71 ejecting the white ink Wh is also referred to as a white nozzle row 71. The nozzle row 72 ejecting the metallic ink Mt is also referred to as a metallic nozzle row 72. In addition, the nozzle rows 73 to 76 ejecting the inks of C, M, Y and K are also referred to as a color nozzle row 77.

When the color nozzle row 77 is equally divided in two in the sub-scanning direction, a nozzle group of one side may be referred to as a first nozzle group NZs1 and the nozzle group of the other side may be referred to as a fourth nozzle group NZs4. In addition, when the metallic nozzle row 72 is equally divided in two in the sub-scanning direction, a nozzle group of one side (the fourth nozzle group NZs4 side) may be referred to as a second nozzle group NZs2 and a nozzle group of the other side (the first nozzle group NZs1 side) may be referred to as a third nozzle group NZs3.

In the printer 10 performing the printing by using the printing head 36, the printing control section 60 is configured such that the printing can be controlled by a first to third nozzle use settings. In the first to third nozzle use settings, types of the used nozzle rows and positions of the nozzle groups are different from each other. Details of the first to third nozzle use settings will be described below.

Figure 4:
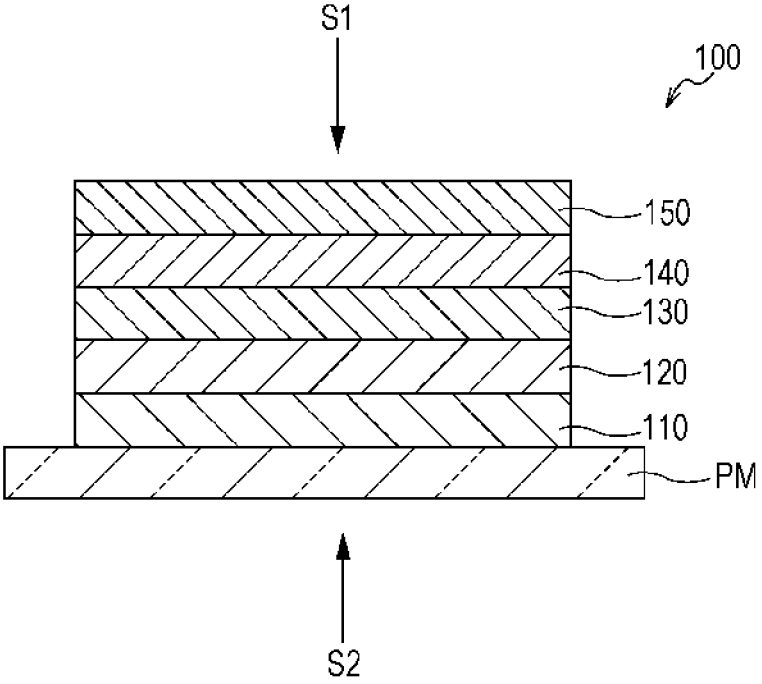
FIG. 4 is an explanatory view illustrating a cross-sectional configuration of a printed matter capable of being printed by the printer.

FIG. 4 illustrates a cross-sectional configuration of a printed matter 100 which can be printed with the printer 10 described above. A transparent printed medium PM is used as the printed matter 100. An ink layer having five layers is formed on one surface of the printed medium PM by the printer 10. The five layers have a first color ink layer 110, a first metallic layer 120, a white layer 130, a second metallic layer 140 and a second color layer 150 in order viewed from the printed medium PM side. The first color ink layer 110 and the second color layer 150 are formed by the color nozzle row 77. The first metallic layer 120 and the second metallic layer 140 are formed by the metallic nozzle row 72. The white layer 130 is formed by the white nozzle row 71. In addition, the white layer 130 may be regarded as a first base layer and the first metallic layer 120 and the second metallic layer 140 may be regarded as a second base layer.

The configuration having the five layers is conceptual, based on the order of forming each layer. Accordingly, the ink dots of different types of colors may not be necessarily formed by overlapping five folds on the printing surface of the printed medium PM in the vertical direction. For example, an area in which the dots of the color ink Col are not formed may be present in the second color layer 150. Otherwise, the dots of the color ink Col as the second color layer 150 may not be formed in the area in which the dots of the metallic ink Mt of the second metallic layer 140 are formed and the dots of the color ink Col as the second color layer 150 may be formed in the area in which the dots of the metallic ink Mt of the second metallic layer 140 are not formed. In this case, the second metallic layer 140 and the second color layer 150 may be an aspect which is formed in substantially the same position in the vertical direction of the surface of the printed medium PM. In the application, this aspect is also included in the ink layer having the configuration of the five layers.

When viewing the printed matter 100 from a side (S1 side in FIG. 4) on which the ink layer is formed, the image of the second color layer 150 having metallic effect expressed by the second metallic layer is visible. On the other hand, when viewing the printed matter 100 from a side (S2 side in FIG. 4) on which the ink layer is not formed, the image of the first color ink layer 110 having the metallic effect expressed by the first metallic layer 120 is visible because the printed medium PM is transparent.

Figure 5:
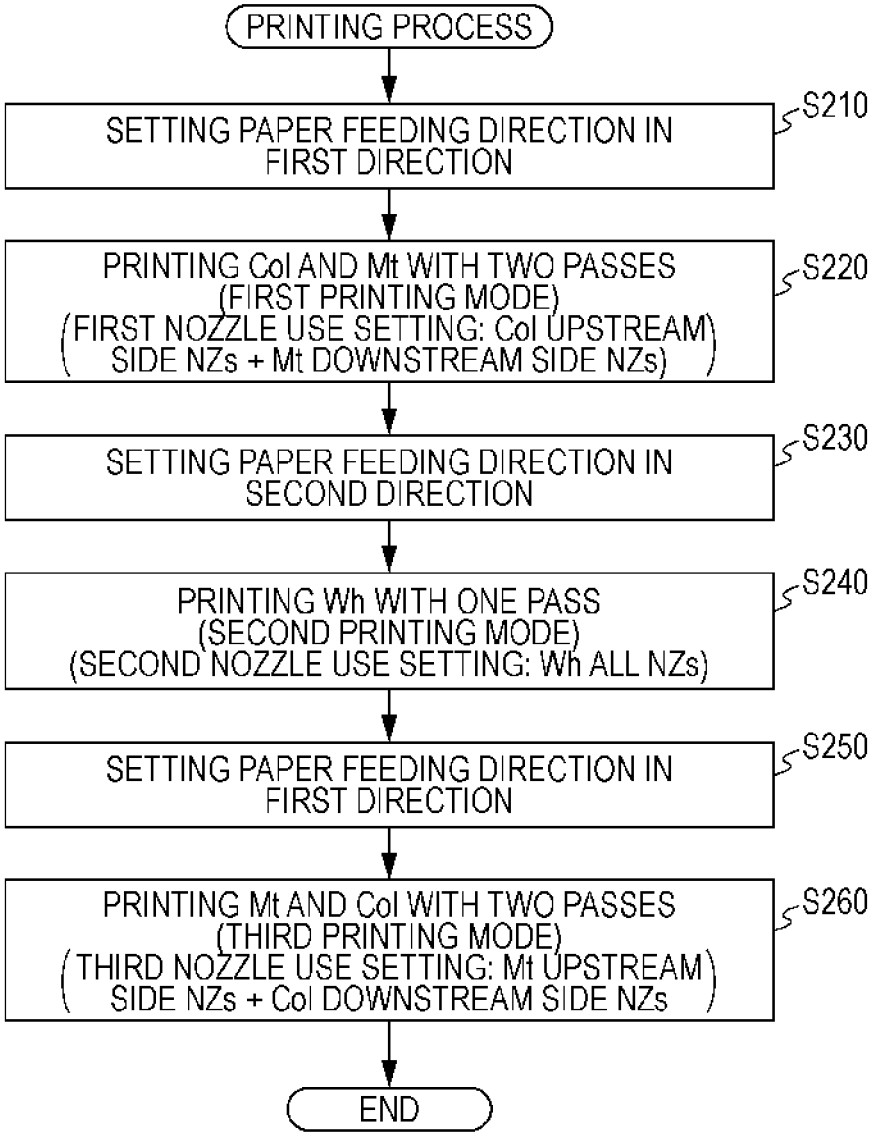
FIG. 5 is a flowchart illustrating a flow of printing process for printing the printed matter.

FIG. 5 illustrates flow of a printing process for printing the printed matter 100 by using the printer 10. When receiving printing instruction, firstly, the printing control section 60 of the printer 10 sets a paper feeding direction (the transportation direction of the printed medium PM) in the first direction (step S210). Next, the printing control section 60 prints the first color ink layer 110 and the first metallic layer 120 by repeating a process which performs sub-scanning by only a predetermined amount in the first direction after ejecting the ink from the printing head 36 by the first nozzle use setting while performing main scanning (step S220). The printing operation is also referred to as a first printing mode in the step S220.

Figure 6:
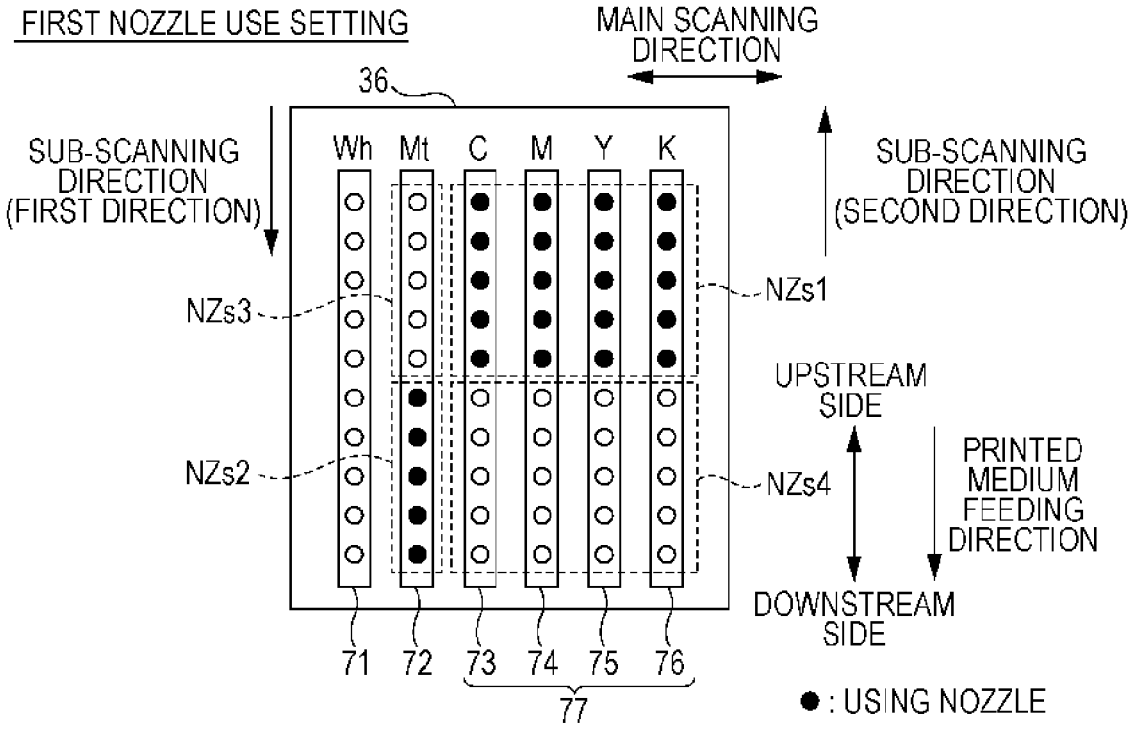
FIG. 6 is an explanatory view illustrating a first nozzle use setting.

FIG. 6 illustrates a content of the first nozzle use setting. In the first nozzle use setting, the color nozzle row 77 and the metallic nozzle row 72 are used, and the white nozzle row 71 is not used. In addition, the first nozzle group NZs1 of the color nozzle row 77 is used and the fourth nozzle group NZs4 is not used. In addition, the second nozzle group NZs2 of the metallic nozzle row 72 is used and the third nozzle group NZs3 is not used. The first nozzle group NZs1 and the second nozzle group NZs2 are used in each main scanning.

When transporting the printed medium PM in the first direction, the first nozzle group NZs1 and the third nozzle group NZs3 are positioned in the upstream side and the fourth nozzle group NZs4 and the second nozzle group NZs2 are positioned in the downstream side thereof. The downstream side is a side on which the printed medium PM moves with respect to the printing head 36, when the printing head 36 and the printed medium PM are relatively moved to each other and then the printing is performed. The upstream side is the opposite side of the downstream side. In other words, the upstream side is a side on which the ink is ejected relatively early onto the same area of the printed medium PM which is transported and the downstream side is a side on which the ink is ejected relatively late. In other words, in the printing control by the first nozzle use setting, the dots of the color ink Col by a first main scanning are formed early with respect to any area of the printed medium PM and then the dots of the metallic ink Mt are formed by a second main scanning (the main scanning which is performed after the first main scanning).

In the embodiment, the first color ink layer 110 and the first metallic layer 120 of any printing area are formed by two main scanning (hereinafter, the number of the main scanning is referred to as the number of passes). Particularly, the first color ink layer 110 having a width corresponding to the first nozzle group NZs1 in the sub-scanning direction is formed in the upstream side and, at the same time, the first metallic layer 120 having a width corresponding to the fourth nozzle group NZs4 in the sub-scanning direction is formed in the downstream side, by one main scanning. Then, after the printed medium PM is transported in the sub-scanning direction by an amount of the first nozzle group NZs1 (the fourth nozzle group NZs4), the first color ink layer 110 having the width corresponding to the first nozzle group NZs1 in the sub-scanning direction is formed by the next main scanning and, at the same time, the first metallic layer 120 having the width corresponding to the fourth nozzle group NZs4 in the sub-scanning direction is formed in the downstream side. Accordingly, the first metallic layer 120 is formed by the next main scanning on the first color ink layer 110 which is formed by an initial main scanning.

As clear from the above description, in the embodiment, the printer 10 forms one raster by one main scanning. The raster is a sequence of the ink dots in the main scanning direction. In addition, the printer 10 forms the ink dots using a so-called band-feeding method. The band-feeding method is a method for completing the raster which is continuous in the sub-scanning direction by each amount of the width of the nozzle group ejecting the ink per one main scanning. However, the printer 10 may form one raster by multiple main scanning. In addition, the printer 10 may form the ink dots by an interlace method. The interlace method is a method for forming another raster between adjacent two rasters formed by one main scanning by at least another main scanning. Even when employing the interlace method, the first metallic layer 120 can be preferably formed on the first color ink layer 110 in any printing area by using the nozzle row which is divided into the upstream side and the downstream side. As clear from the above description, in step S220, the number of the passes forming the first color ink layer 110 and the first metallic layer 120 of any printing area (the printing area having two or more pixels in the main scanning direction and the sub-scanning direction) is defined as 2×M times (M is an integer of 1 or more). When increasing the value of M, degradation of printing quality due to a so-called banding in which a joint between the areas which are printed by one scanning is recognized as a horizontal stripe can be suppressed.

In addition, in the embodiment, the printing control section 60 controls dot forming positions of the first color ink layer 110 and dot forming positions of the first metallic layer 120 so as not to overlap each other as much as possible. The control is also referred to as overlap suppression control. The overlap suppression control can be performed using various methods. Hereinafter, halftone process, which determines ON/OFF of the dot of each pixel position from the image data of printing object, is described as being performed by a systematic dither method. In addition, the overlap suppression control may be appropriately employed depending on desired printing quality and is not an essential control.

As a first method of the overlap suppression control, a method can be exemplified in which dither masks, of which placements of threshold values are different from each other, are used between the halftone process for the color ink Col and the halftone process for the metallic ink Mt. Since the placement of the threshold value of the dither mask represents the dot pattern formed according to a printing gradation value, the dots of the color ink Col and the dots of the metallic ink Mt are overlapped with each other when the same dither mask is used in both halftone processes. On the other hand, when the dither masks, of which the placement of the threshold values is different from each other, are used, the overlap of the dots can be suppressed. For example, the halftone process for the metallic ink Mt may use the dither mask configured of a threshold values group, which is shifted by each predetermined pixel in a predetermined direction, configuring the dither mask which is used in the halftone for the color ink Col. In this way, since making two types of the dither masks is omitted, it is possible to reduce man-hours in manufacturing the printer 10.

As a second method of the overlap suppression control, a method may be exemplified in which firstly, the halftone process is performed for the metallic ink Mt and a result thereof is reflected thereby performing the halftone process for the color ink Col. Particularly, the printing control section 60 may determine the dots of the color ink Col as OFF at a pixel position in which the dots of the metallic ink Mt is determined as ON. In addition, the printing control section 60 may determine ON/OFF of the dots by comparing the threshold value of the dither mask with a value which is added with a gradation value of the metallic ink Mt at the pixel position to the gradation value of the color ink Col at the pixel position in which the dots of the metallic ink Mt is determined as OFF. According to the second method, the overlap of the dots can be further suppressed.

By performing the overlap suppression control, the chroma reproduced by the dots of the color ink Col can be suppressed from degrading due to the dots of the metallic ink Mt which are overlapped on the dots of the color ink Col. The overlap suppression control may be performed between the metallic ink Mt and all color ink Col or may be performed only between the metallic ink Mt and a part of the color ink Col. For example, the overlap suppression control is not performed with respect to the black ink K of which the chroma is less likely to generally decrease and the overlap suppression control may be performed with respect to the other color inks Col. Therefore, the halftone process can be simplified.

Herein, the description is returned to FIG. 5. When forming the first color ink layer 110 and the first metallic layer 120, the printing control section 60 sets the paper feeding direction in the second direction (step S230). In other words, the printing control section 60 performs the back feed in the subsequent printing.

Next, the printing control section 60 prints the white layer 130 by repeating the process which performs the sub-scanning by each predetermined amount in the second direction after ejecting the ink from the printing head 36 in the second nozzle use setting while performing the main scanning (step S240). The printing operation is also referred to as a second printing mode in the step S220. As described above, the printing control section 60 performs the printing by switching the operation of the printing mechanism 20 from the first printing mode to the second printing mode, which is caused by switching the paper feeding direction from the first direction to the second direction. In step S240, since the printed medium PM is transported in the second direction, the directions of the upstream side and the downstream side are opposite to that as in step S220 described above.

Figure 7:
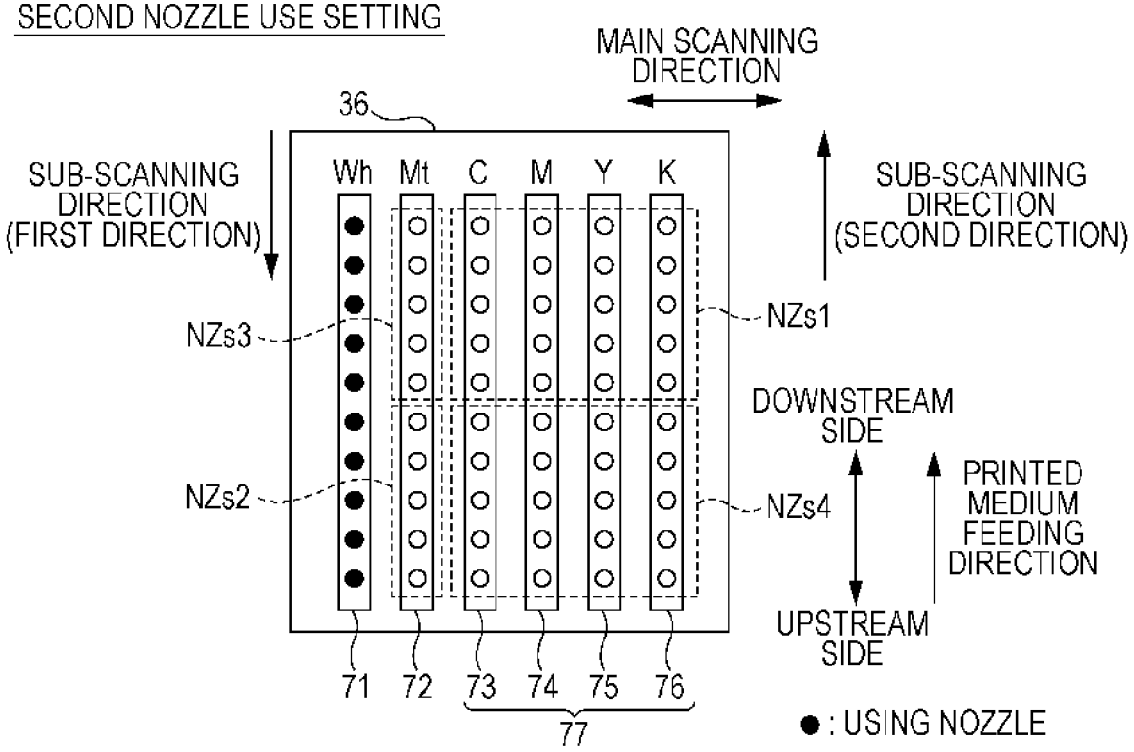
FIG. 7 is an explanatory view illustrating a second nozzle use setting.

FIG. 7 illustrates a content of the second nozzle use setting. In the second nozzle use setting, only the white nozzle row 71 is used, and the color nozzle row 77 and the metallic nozzle row 72 are not used. In addition, all nozzles configuring the white nozzle row 71 are used.

In the embodiment, the white layer 130 of any printing area is formed by one main scanning. The printing of the white layer 130 can be sped up by using a whole range of the white nozzle row 71 and by performing the printing with a small number of the passes. Since the white layer 130 functions as the base layer and is not intended to be viewed as the image, influence thereof on printing quality is small even in the configuration. However, the white layer 130 may be formed by two or more passes. If the number of the passes in the second printing mode is less than that in the first printing mode and the third printing mode described below, the printing can be sped up.

When the white layer 130 is formed, the printing control section 60 sets the paper feeding direction in the first direction (step S250). In other words, in the subsequent printing, the printing control section 60 performs the back feed again.

Next, the printing control section 60 prints the second metallic layer 140 and the second color layer 150 by repeating the process which performs the sub-scanning by a predetermined amount in the first direction after ejecting the ink from the printing head 36 in the third nozzle use setting while performing the main scanning (step S260) and the printing process is finished. The printing operation is also referred to as a third printing mode in the step S260. As described above, the printing control section 60 performs the printing by switching the operation of the printing mechanism 20 from the second printing mode to the third printing mode, which is caused by switching the paper feeding direction from the second direction to the first direction. In step S260, since the printed medium PM is transported in the first direction, the directions of the upstream side and the downstream side are the same as those of the step S220 described above.

Figure 8:
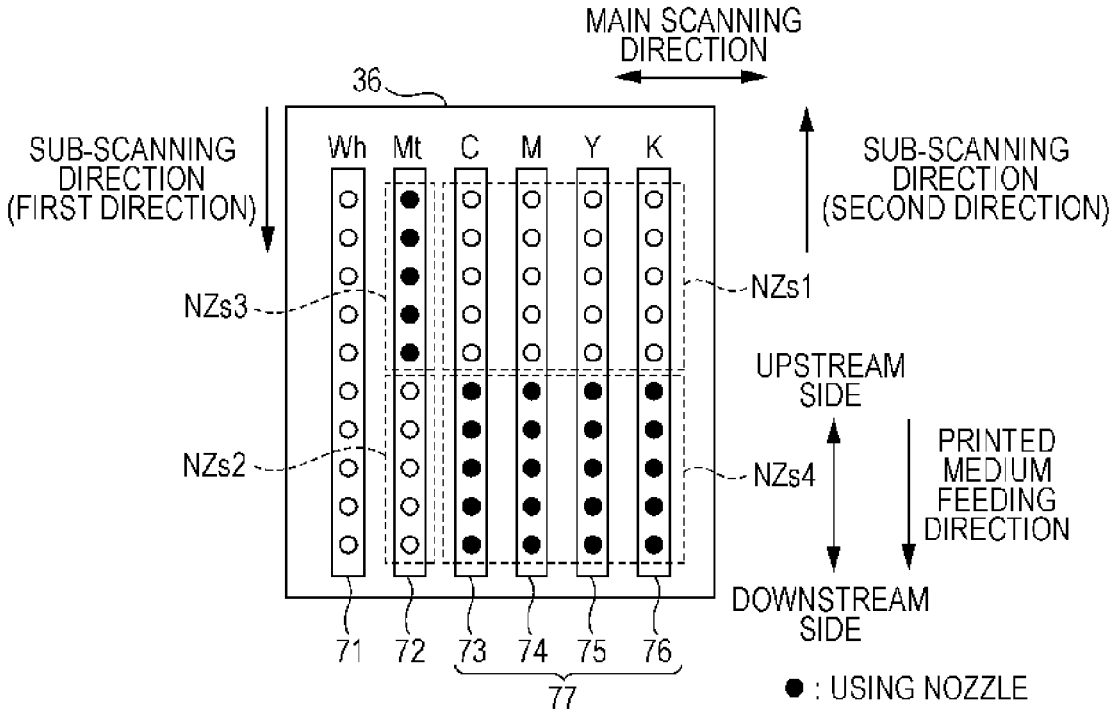
FIG. 8 is an explanatory view illustrating a third nozzle use setting.

FIG. 8 illustrates a content of the third nozzle use setting. In the third nozzle use setting, the color nozzle row 77 and the metallic nozzle row 72 are used, and the white nozzle row 71 is not used. In addition, the fourth nozzle group NZs4 of the color nozzle row 77 positioned on the downstream side is used and the first nozzle group NZs1 positioned on the upstream side is not used. In addition, the third nozzle group NZs3 of the metallic nozzle row 72 positioned on the upstream side is used and the fourth nozzle group NZs4 positioned on the downstream side is not used. Thus, in the printing control in the third nozzle use setting, the dots of the metallic ink Mt is formed early by the first main scanning and then the dots of the color ink Col are formed by the second main scanning with respect to any area of the printed medium PM.

As clear from the above description, the third nozzle use setting is obtained by replacing the upstream side with the downstream side of the nozzle group of the nozzle rows which is used with respect to the first nozzle use setting.

In the embodiment, the second metallic layer 140 and the second color layer 150 of any printing area are formed by two main scanning similar to the first color ink layer 110 and the first metallic layer 120. However, herein, the number of the passes may be 2×N times (N is an integer of 1 or more) similar to the first color ink layer 110 and the first metallic layer 120.

The first printing mode and the third printing mode of the printer 10 described above correspond to the first printing mode in the claims. The second printing mode of the printer 10 corresponds to the second printing mode in the claims. In addition, the first nozzle use setting and the third nozzle use setting of the printer 10 correspond to the first nozzle use setting in the claims. The second nozzle use setting of the printer 10 corresponds to the second nozzle use setting in the claims.

According to the printer 10 described above, the printed matter 100 configured of the ink layer having the five layers formed of the first color ink layer 110, the first metallic layer 120, the white layer 130, the second metallic layer 140 and the second color layer 150 in order viewed from the printed medium PM can be printed on one surface of the printed medium PM. Accordingly, if printing is performed on the transparent printed medium PM, the printed matter 100 on which the printed image is visible from both surfaces thereof can be obtained. The printer 10 may print mirror images of the image formed on the printed medium PM side rather than the white layer 130 and the image formed on the opposite side thereof. In this way, the same image is visible even though the printed matter 100 is observed from one of both surfaces of the printed matter 100. In addition, since the ink layer is formed on only one surface of the printed matter 100, the ink is not attached to the transparent member when the surface on which the ink layer is not formed is attached by coming into contact with the transparent member such as a window.

In addition, according to the printer 10, two layers of the first color ink layer 110 and the first metallic layer 120 can be formed in the first printing mode during one transportation process which transports the printed medium PM throughout the length of the printed medium PM in the first direction. Accordingly, shift of relative position relationship between two layers is difficult to occur compared to a case where the first color ink layer 110 and the first metallic layer 120 are printed in separated transportation processes. Accordingly, degradation of the printing quality can be suppressed. The same applies to the second metallic layer 140 and the second color layer 150.

In addition, according to the printer 10, the printing of the ink layer for the five layers can be performed by total three transportation processes, one for each in the first to third printing modes (also referred to as "multiple-time transportation printing"). Herein, in the multiple-time transportation printing, the number of the nozzles for each nozzle group which is divided can be greater than that of a case (also referred to as "one-time transportation printing") where the printing of the ink layer for the five layers is performed in one time of the transportation process in which the nozzle row is used by dividing the nozzle groups into five. Accordingly, in the multiple-time transportation printing, the number of the passes which print any printing area can be less than that of the one-time transportation printing. In addition, in the one-time transportation printing, the printing of each of the layers 110 to 150 with respect to one raster is performed in short time intervals and possibility of color mixing of inks between the layers 110 to 150 is increased. Therefore, in the one-time transportation printing, it is necessary to provide a drying process in which the movement of the printing head 36 is stopped in a predetermined time for one pass or the like and to sufficiently secure the drying time of the ink of each of the layers 110 to 150. On the other hand, in the multiple-time transportation printing, since the time intervals to perform the printing of each of the layers 110 to 150 with respect to one raster can be increased compared to those of the one-time transportation printing, it is possible to omit the drying process or to reduce the time spent in the drying process. Accordingly, in the multiple-time transportation printing, the printing speed can be sped up compared to the one-time transportation printing.

In addition, in the one-time transportation printing, since the number of the passes which print any printing area is great, the number of the paper feeding operation is increased when printing any printing area. Thus, in the one-time transportation printing, the image quality may be degraded by receiving large influence of a paper feeding error. On the other hand, in the multiple-time transportation printing, since the number of the passes which prints any printing area can be decreased, the number of the paper feeding operation can be decreased. Accordingly, in the multiple-time transportation printing, the possibility of the degradation of the image quality due to the paper feeding error can be reduced compared to the one-time transportation printing.

In addition, in the configuration in which the nozzle rows are divided in five nozzle groups, the color ink Col is ejected from the uppermost nozzle group of the nozzle groups divided in five, the metallic ink Mt is ejected from the second upstream side nozzle group, the white ink Wh is ejected from the third upstream side nozzle group, metallic ink Mt is ejected from the fourth upstream side nozzle group and the color ink Col is ejected from the lowest downstream side nozzle group.

In addition, according to the printer 10, the white layer 130 may be formed between the first metallic layer 120 and the second metallic layer 140. The light is less likely to be transmitted through the printed surface of the printed matter 100 by forming the white layer 130 as the base layer. Accordingly, reproducibility of the color of the printed image can be good even when viewing the printed matter 100 from one of both surfaces of the printed matter 100.

In addition, according to the printer 10, the printed medium PM can be back fed. Thus, a user does not need to set the printed medium PM at a predetermined initial position of the printer 10 for each time when the transportation of the printed medium PM in one direction is finished. Accordingly, convenience of the user is improved and thus, the printing speed can be sped up. In addition, in the printer 10, timing to reverse the transportation direction of the printed medium PM is (1) between the printing of the first metallic layer 120 and the second metallic layer 140, and the printing of the white layer 130, and (2) between the printing of the white layer 130 and the printing of the second metallic layer 140 and the second color layer 150. In the timing of (1) or (2) described above, shift between the white layer 130 as the base layer and the other ink layers does not give large influence to the printing quality even though the forming position of the dots between the ink layers is shifted. Accordingly, the printing quality is not greatly reduced.

B. Modification Example

B-1. Modification Example 1

Various special gloss inks which contain pigment expressing a predetermined texture of a material may be used in place of the metallic ink Mt described above. As the special gloss ink, a pearlescent gloss ink containing a pigment expressing a pearlescent gloss effect after being fixed onto the surface of the printed medium, for example, a pigment containing multiple stacked thin film layers having a pearl color like a natural pearl, a lame ink or a translucent ink containing pigments which have microscopic irregularities so as to give rise to scattered reflection after being fixed onto the surface of the printed medium to create a so-called lame or translucent effect, and the like can be exemplified. The special gloss ink may be regarded to be an ink in which optical properties of the ink printed on the printed medium have reflection angle dependence.

In addition, a different type of the special gloss ink may be used between the first metallic layer 120 and the second metallic layer 140. In this case, the printing head 36 may include a different nozzle row for each type of the special gloss ink. Otherwise, the printer 10 may be configured such that the nozzle group of the upstream side and the nozzle group of the downstream side in one nozzle row eject different special gloss inks.

B-2. Modification Example 2

The printed matter which is printed by the printer 10 is not limited to the printed matter configured of the ink layer having the five layers and may be a printed matter having six or more layers. For example, a coating layer may be formed using a clear ink and the like on the second color layer 150 of the printed matter 100. In this case, the coating layer may be printed while the printed medium PM is transported again in the second direction after step S260 described above (see FIG. 5).

B-3. Modification Example 3

At least some of a plurality of ink types used by the printer 10 may be an ultraviolet curable ink. In this case, the printer 10 may include an ultraviolet irradiation section which irradiates ultraviolet rays toward the printed medium PM. The ultraviolet irradiation section may be provided over the whole main scanning direction on the upstream side and the downstream side of the printing head 36. Otherwise, the ultraviolet irradiation section may be provided in the printing head 36. According to the configuration, it is possible to suppress that different types of the inks are mixed together before being fixed on the printed medium PM.

B-4. Modification Example 4

The nozzle row is not limited to the configuration which is divided into the upstream side and the downstream side. For example, the printer 10 may print the printed matter including the ink layer which has a configuration of (2P+1) layers using the nozzles by dividing the nozzles into P (P is an integer of 2 or more). In this case, the printing may be performed using a first nozzle use setting in which a divided nozzle group of a p-th from the upstream side is used as the use range in the nozzle row of the p-th (p is the integer from 1 to P), a second nozzle use setting in which a whole nozzle row of a (P+1)-th is used as the use range and a third nozzle use setting in which the divided nozzle group of the p-th from the downstream side is used as the use range in the p-th nozzle row in order of the first, second and third nozzle use settings. In this way, the printed matter including the ink layer having (2P+1) layers can be preferably printed similar to the embodiment described above.

In this case, the number of the passes which print any printing area in the first printing mode can be P×M times. The number of the passes in the second printing mode can be one time. The number of the passes in the third printing mode can be P×N times.

B-5. Modification Example 5

The number of the passes in the second printing mode is not limited to one time and may be appropriately set within the range of the number of the passes which is fewer than that of the first printing mode and the third printing mode. In this way, it makes printing speed slower than the embodiment described above; however, in any other respects, the same effects as the embodiment described above are accomplished. Such configuration is useful when a desired hue is given to the first base layer (the white layer 130 in the embodiment described above). For example, the number of the passes may be two in the second printing mode. In this case, the printer 10 may eject the white ink Wh using the whole range of the white nozzle row 71 with an initial main scanning and may eject the color ink Col using the whole range of the color nozzle row 77 with the next main scanning. Of course, it is also possible to use the nozzle dividing technique similar to the first printing mode or the like.

However, the number of the passes in the second printing mode does not necessarily need to set fewer than the number of the passes of the first printing mode and the third printing mode. For example, the number of the passes in the second printing mode may be the same as the number of the passes of the first printing mode and the third printing mode.

B-6. Modification Example 6

The first printing mode and the third printing mode are not limited to the printing control using the nozzle dividing technique. For example, in these printing modes, after the first ink layer (for example, the first color ink layer 110) is formed by the main scanning of Q (Q is an integer of 1 or more) using the whole range of predetermined nozzles, the second ink layer (for example, the first metallic layer 120) may be formed by the main scanning of R (R is an integer of 1 or more) using the whole range of other predetermined nozzles. In this case, the first ink layer and the second ink layer are formed in a state where the sub-scanning is not performed. In other words, the printing head 36 moves multiple on the same printing area of the printed medium PM.

When the first ink layer is the color ink layer and the second ink layer is the metallic layer, it is preferable that the value R be equal to or smaller than the value Q and it is more preferable that the value R be the value 1. When R=1, the second ink layer is formed by only final main scanning of plural times of main scanning which print any printing area. According to the configuration, the printing can be sped up compared to the case of R≥2.

B-7. Modification Example 7

The technique of the printer 10 described above may be applied even when the printed matter configured of the ink layer having three layers or four layers is printed. For example, the printer 10 may form the ink having one layer by switching the operation of the printer 10 from the first printing mode to the second printing mode, which is caused by forming the ink layer having two layers in the first printing mode and by switching the paper feeding direction from the first direction to the second direction. According to the operation, the printed matter configured of the ink layer having three layers can be printed. In this case, the printed medium PM may not be transparent. When the printed medium PM is not transparent, the printing may be performed in the first printing mode after the printing is performed in the second printing mode. The printed matter configured of the ink layer having four layers may be printed by further performing the printing of one layer on the ink layer having three layers which is formed as described above.

According to the configuration, the printing speed can be sped up compared to the case where the printed matter configured of the ink layer having three layers or four layers by dividing the nozzle row into three or four. Therefore, a problem of the speedup of the printing speed of the printing apparatus can be solved. In addition, according to the configuration, since the ink layer having two layers can be formed by the first printing mode, the relative position relationship between two layers is difficult to be shifted. Therefore, a problem of suppressing the degradation of the printing quality can be solved.

In addition, the invention is not limited to the embodiment, the example and the modification examples described above and can be implemented with various configurations within the scope not departing from the gist. For example, technical features in the embodiment, the example and the modification examples corresponding to the technical features in each aspect described in the summary of the invention may appropriately perform replacement or combination thereof in order to solve some or all of the problems described above or to obtain some or all of the effects described above. In addition, the technical features may be appropriately removed if it is not described as essential in the specification.

The entire disclosure of Japanese Patent Application No. 2012-155253, filed Jul. 11, 2012 is expressly incorporated by reference herein.

What is claimed is:

1. A printing apparatus, which prints an image on a printed medium, comprising:

a printing mechanism performing printing by ejecting ink from a printing head which is relatively moved with respect to the printed medium in a main scanning direction and a sub-scanning direction crossing the main scanning direction; and a printing control section controlling operation of the printing mechanism, wherein a plurality of nozzle rows in which a plurality of nozzles ejecting the ink are arranged side by side in a predetermined range in the sub-scanning direction are formed side by side for each of ink types in the main scanning direction in the printing head, wherein the printing mechanism includes a transportation section which is configured so as to be capable of transporting the printed medium in a first direction of the sub-scanning direction and a second direction opposite to the first direction, and is configured so as to be capable of switching a transportation direction of the printed medium which is transported in one of the first direction and the second direction to the other direction, wherein the printing control section is configured so as to be capable of performing the printing by a first printing mode which performs the printing over an entire printing area on which the image is to be printed by using two or more nozzle rows having different ink types of the plurality of the nozzle rows; and a second printing mode which performs the printing over the entire printing area by using one or more nozzle rows including nozzle rows different from the two or more nozzle rows of the plurality of the nozzle rows, and wherein the printing control section performs the printing by switching the first printing mode and the second printing mode, which is caused by switching the transportation direction in the transportation section, wherein the first printing mode is an operation which performs the printing with respect to any printing area of the printed medium with the number of a first main scanning, and wherein the second printing mode is an operation which performs the printing with respect to any printing area of the printed medium with the number of a second main scanning which is less than the number of the first main scanning.

2. A printing apparatus, which prints an image on a printed medium, comprising:

a printing mechanism performing printing by ejecting ink from a printing head which is relatively moved with respect to the printed medium in a main scanning direction and a sub-scanning direction crossing the main scanning direction; and a printing control section controlling operation of the printing mechanism, wherein a plurality of nozzle rows in which a plurality of nozzles ejecting the ink are arranged side by side in a predetermined range in the sub-scanning direction are formed side by side for each of ink types in the main scanning direction in the printing head, wherein the printing mechanism includes a transportation section which is configured so as to be capable of transporting the printed medium in a first direction of the sub-scanning direction and a second direction opposite to the first direction, and is configured so as to be capable of switching a transportation direction of the printed medium which is transported in one of the first direction and the second direction to the other direction, wherein the printing control section is configured so as to be capable of performing the printing by a first printing mode which performs the printing over an entire printing area on which the image is to be printed by using two or more nozzle rows having different ink types of the plurality of the nozzle rows; and a second printing mode which performs the printing over the entire printing area by using one or more nozzle rows including nozzle rows different from the two or more nozzle rows of the plurality of the nozzle rows, and wherein the printing control section performs the printing by switching the first printing mode and the second printing mode, which is caused by switching the transportation direction in the transportation section, wherein the first printing mode is an operation which performs the printing by a first nozzle use setting of which a use range is a first nozzle group of one of a downstream side and an upstream side which is the opposite side of the downstream side which is a side in which the printed medium is moved with respect to the printing head of the predetermined range in the first nozzle row of the two or more nozzle rows, and of which the use range is a second nozzle group of the other side in the second nozzle row which is different from the first nozzle row, and wherein the second printing mode is an operation which performs the printing by a second nozzle use setting of which the use range is an entire third nozzle row different from the first nozzle row and the second nozzle row.

3. The printing apparatus according to claim 1, wherein the control section prints the image configured of an ink layer having five layers on one surface of the printed medium by forming the ink layer having two layers by the first printing mode, by forming the ink layer having one layer by the second printing mode which is performed after the first printing mode, and by forming the ink layer having two layers by the first printing mode which is performed again after the second printing mode.

4. A printing method in which a printing apparatus performs printing by ejecting ink from a printing head which is relatively moved with respect to a printed medium in a main scanning direction and a sub-scanning direction crossing the main scanning direction, and which has a plurality of nozzle rows in which a plurality of nozzles ejecting the ink are arranged side by side in a predetermined range in the sub-scanning direction being formed side by side for each of the ink types in the main scanning direction, comprising:

performing during a first printing mode the printing over an entire printing area on which an image is to be printed by using two or more nozzle rows having different ink types of the plurality of the nozzle rows, in a state where the printed medium is transported in a first direction of the sub-scanning direction;

performing during a second printing mode the printing over the entire printing area by using one or more nozzle rows of the plurality of the nozzle rows, including the nozzle rows which are different from the two or more nozzle rows, in a state where the printed medium is transported in a second direction, which is caused by switching the transportation direction of the printed medium from the first direction to the second direction opposite to the first direction; and performing the printing over the entire printing area by using the two or more nozzle rows, in a state where the printed medium is transported in the first direction, which is caused by switching the transportation direction of the printed medium from the second direction to the first direction, wherein the first printing mode is an operation which performs the printing with respect to any printing area of the printed medium with the number of a first main scanning, and wherein the second printing mode is an operation which performs the printing with respect to any printing area of the printed medium with the number of a second main scanning which is less than the number of the first main scanning.

* * * * *